US008413620B2

(12) United States Patent
Shin et al.

(10) Patent No.: US 8,413,620 B2
(45) Date of Patent: Apr. 9, 2013

(54) HYDRAULIC ORIFICE

(75) Inventors: Gee Wook Shin, Hwaseong-si (KR); Yoonsik Woo, Yongin-si (KR); Jin Kook Kong, Suwon-si (KR); Soo Hyung Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 368 days.

(21) Appl. No.: 12/946,284

(22) Filed: Nov. 15, 2010

(65) Prior Publication Data

US 2012/0055440 A1 Mar. 8, 2012

(30) Foreign Application Priority Data

Sep. 3, 2010 (KR) ..... 10-2010-0086675

(51) Int. Cl.
*F01L 9/02* (2006.01)

(52) U.S. Cl.
USPC ..... 123/90.12; 123/292; 251/315.08

(58) Field of Classification Search ..... 123/90.12, 123/292; 251/315.08
See application file for complete search history.

(56) References Cited

U.S. PATENT DOCUMENTS 6,832,539 B2 * 12/2004 Colby ..... 92/14

FOREIGN PATENT DOCUMENTS

JP 2005-061342 (A) 3/2005

* cited by examiner

*Primary Examiner* — Zelalem Eshete
(74) *Attorney, Agent, or Firm* — Morgan, Lewis & Bockius LLP

(57) ABSTRACT

A hydraulic orifice which is mounted at a head oil journal formed in a cylinder head and supplies an oil to a supply line after reducing pulsation of the oil supplied to the head oil journal, may include a body pressed on the head oil journal so as to form a chamber with the cylinder head, a joining line formed along a longitudinal axis of the body therein and fluid-communicating with the supply line, and at least two hydraulic lines formed in the body and connecting the chamber with an end of the joining line in the body to supply the oil through the other end thereof to the supply line, wherein the oils passing through the at least two hydraulic lines are joined at the end of the joining line with different phases such that the pulsation of the oil in the joining line is reduced.

11 Claims, 6 Drawing Sheets

HYDRAULIC ORIFICE

CROSS-REFERENCE TO RELATED APPLICATION

The present application claims priority to Korean Patent Application No. 10-2010-0086675 filed in the Korean Intellectual Property Office on Sep. 3, 2010, the entire contents of which is incorporated herein for all purposes by this reference.

BACKGROUND OF THE INVENTION

1. Field of the Invention

The present invention relates to a hydraulic orifice, and more particularly to a hydraulic orifice which reduces pulsation of an oil supplied to a variable valve apparatus of an engine.

2. Description of Related Art

Generally, oil pressurized at a hydraulic pump passes through a hydraulic line in a cylinder block and is supplied to a cylinder head. Finally, the oil is supplied to various variable valve apparatuses through an oil control valve.

A head oil journal is formed between the cylinder block and the cylinder head of the engine, and a hydraulic orifice is mounted at the head oil journal such that a flow direction, a pressure, and a pulsation of the oil received from the hydraulic pump are controlled and the controlled oil is supplied to the oil control valve.

A conventional hydraulic orifice is mounted at a head oil journal formed in a cylinder head, and supplies oil received from a hydraulic pump to a supply line.

The hydraulic orifice includes an outer case and an inner case, the outer case is pressed on the head oil journal, and the inner case is pressed on an interior circumference of the outer case. At this time, a forming portion formed at the outer case is bent toward the inner case so as to assemble the inner case to the outer case.

An inner chamber is formed in the inner case. In addition, an oil hydraulic line for connecting the inner chamber with the supply line is formed at an exterior circumference of the inner case. The oil hydraulic line has spiral shape.

According to a conventional hydraulic orifice, however, pulsation of the oil is reduced when passing through the oil hydraulic line. Therefore, the oil hydraulic line having suitable length should be formed. For this purpose, the oil hydraulic line of spiral shape should be formed and it may be difficult to form the oil hydraulic line.

In addition, since the outer case and the inner case are assembled by bending the forming portion formed at the outer case toward the inner case, a diameter difference between both ends of the outer case cannot be controlled within a predetermined error range. Since the oil hydraulic line is formed at the exterior circumference of the inner case, a part of the oil hydraulic line may be blocked when the forming portion is bent.

Further, when pressing the outer case on the head oil journal, an oil passage flowing the oil received from the hydraulic pump into the cylinder head and a supply hole of the outer case should be aligned. For this purpose, an additional tool should be necessary and it may be hard to assemble.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a hydraulic orifice having advantages of reducing pulsation as a consequence that a joining line and at least two hydraulic lines connecting the joining line with a head oil journal are formed at a body of one piece, and oils passing through at least two hydraulic lines are joined at the joining line with different phases and to provide a hydraulic orifice which has a simple structure by using the head oil journal as a chamber. Therefore, the hydraulic orifice can be easily assembled and manufacturing cost may be reduced.

In an aspect of the present invention, the hydraulic orifice which may be mounted at a head oil journal formed in a cylinder head and supplies an oil to a supply line after reducing pulsation of the oil supplied to the head oil journal may include a body pressed on the head oil journal so as to form a chamber with the cylinder head, a joining line formed along a longitudinal axis of the body therein and fluid-communicating with the supply line, and at least two hydraulic lines formed in the body and connecting the chamber with an end of the joining line in the body to supply the oil through the other end thereof to the supply line, wherein the oils passing through the at least two hydraulic lines may be joined at the end of the joining line with different phases such that the pulsation of the oil in the joining line may be reduced.

The at least two hydraulic lines may have different lengths such that the oils passing through the at least two hydraulic lines may be joined at the end of the joining line with the different phases.

The end of the joining line may be wider than the other end thereof to form a conical shape.

The head oil journal abuts on the supply line, and a diameter of the head oil journal may be larger than that of the supply line, and an end of the body may be pressed on the head oil journal and the other end of the body may be pressed on the supply line such that the chamber may be formed between the end of the body and the head oil journal.

The head oil journal abuts on the supply line, and a diameter of the head oil journal may be larger than that of the supply line, and wherein a diameter of both ends of the body may be larger than that of a middle portion of the body and the both ends of the body may be pressed on the head oil journal such that the chamber may be formed between the both ends of the body and the head oil journal.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
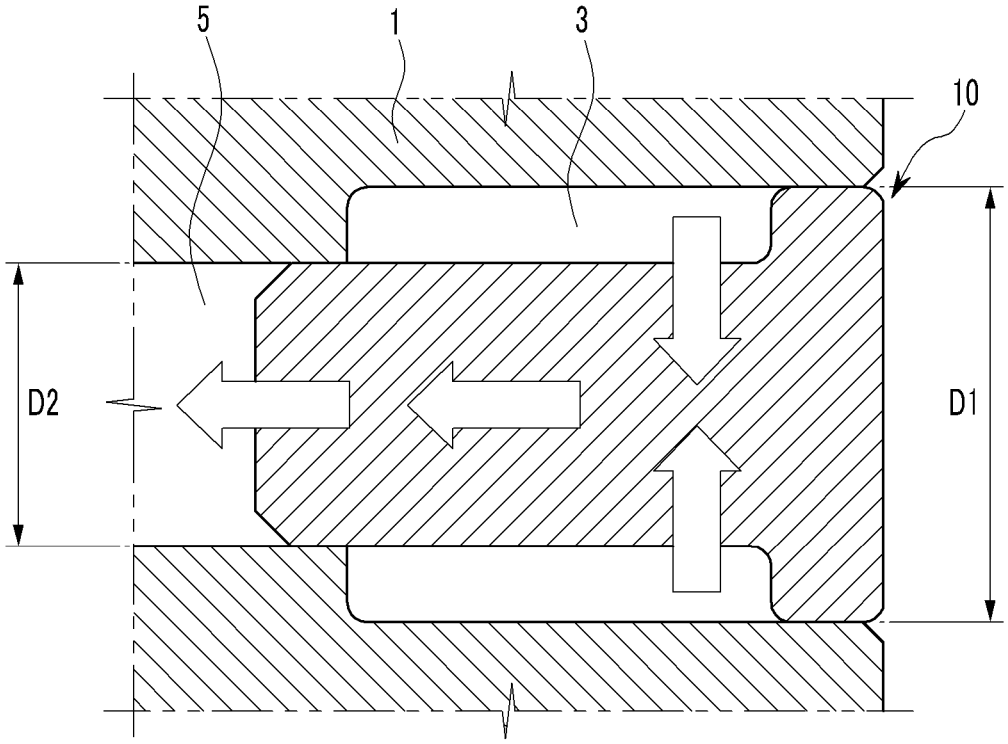
FIG. 1 is a schematic diagram showing that a hydraulic orifice according to an exemplary embodiment of the present invention is mounted at a head oil journal.
Figure 2:
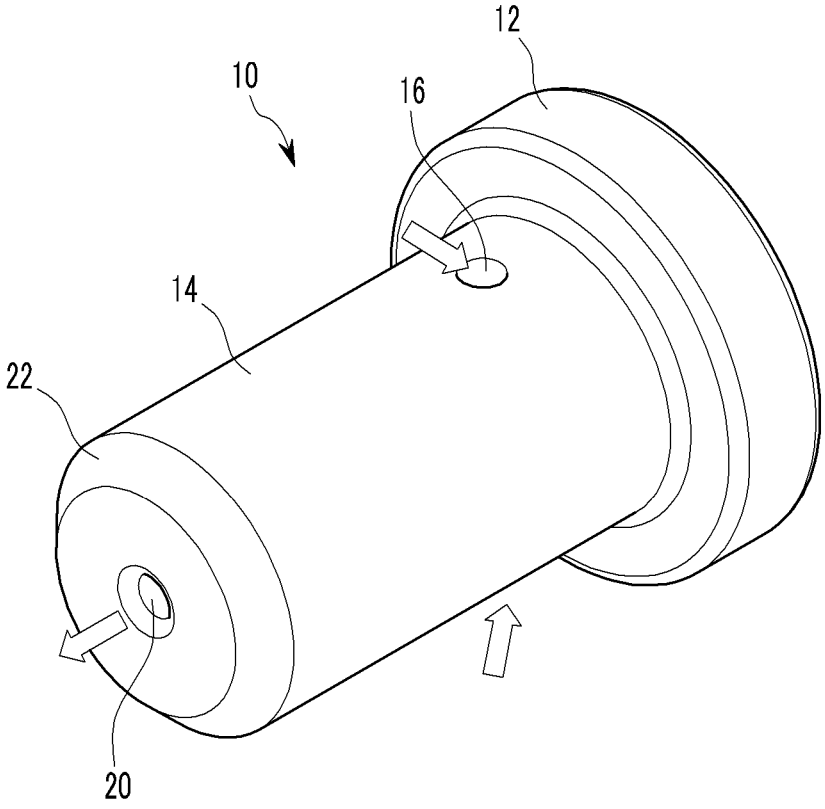
FIG. 2 is a perspective view of a hydraulic orifice according to an exemplary embodiment of the present invention.
Figure 3:
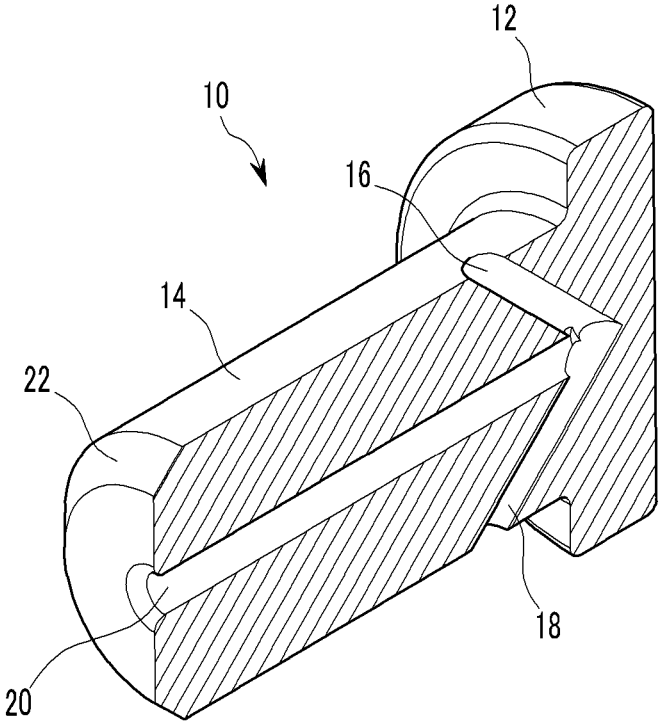
FIG. 3 is a cross-sectional view of a hydraulic orifice according to an exemplary embodiment of the present invention.
Figure 4:
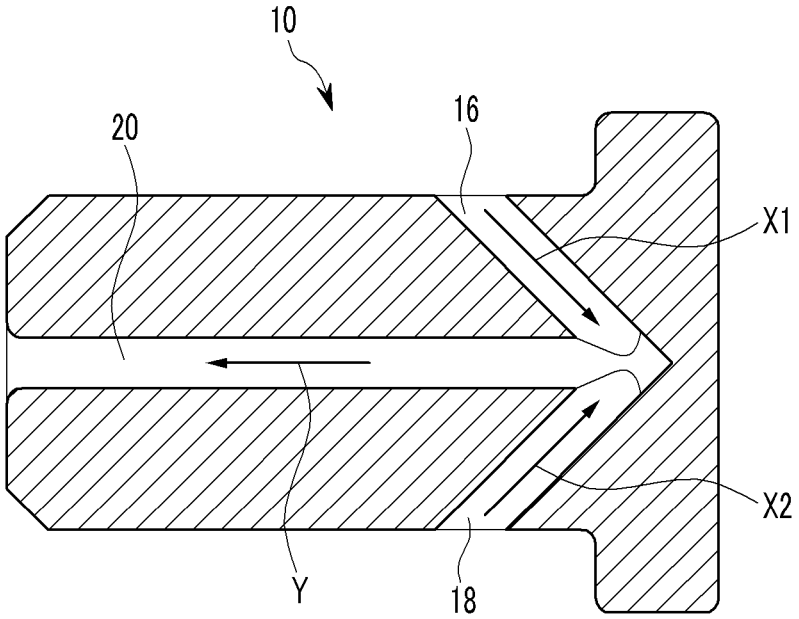
FIG. 4 is another cross-sectional view of a hydraulic orifice according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

FIG. 1 to FIG. 4 show a hydraulic orifice according to an exemplary embodiment of the present invention.

As shown in FIG. 1 to FIG. 4, a hydraulic orifice 10 according to an exemplary embodiment of the present invention is mounted at a head oil journal 3 formed in a cylinder head 1, and supplies oil received from a hydraulic pump to a supply line 5. The oil in the supply line 5 is finally supplied to various variable valve apparatuses through an oil control valve.

The head oil journal 3 is formed at a coupling portion of the cylinder head 1 and a cylinder block, and the supply line 5 abuts on the head oil journal 3. In addition, a diameter D1 of the head oil journal 3 is larger than that D2 of the supply line 5.

The hydraulic orifice 10 includes a body 14 of one piece. The body 14 has circular cylinder shape. According to the first exemplary embodiment of the present invention, a diameter of one end 12 of the body 14 is larger than that of the other end of the body 14. That is, the body 14 has 'T' shape. The one end 12 of the body 14 is pressed on an interior circumference of the head oil journal 3, and the other end of the body 14 is pressed on the supply line 5. Therefore, a chamber is formed between the one end 12 of the body 14 and the head oil journal 3. For this purpose, the diameter of the one end 12 of the body 14 is almost the same as that D1 of the head oil journal 3, and the diameter of the other end of the body 14 is almost the same as that D2 of the supply line 5. In addition, a chamfer portion 22 may be formed at an exterior circumference of the other end of the body 14 such that the body 14 is easily pressed on the supply line 5.

The chamber receives the oil from the hydraulic pump.

First and second hydraulic lines 16 and 18 and a joining line 20 are formed in the body 14.

The first and second hydraulic lines 16 and 18 are formed from the exterior circumference of the body 14 to an inside of the body 14. More concretely, one ends of the first and second hydraulic lines 16 and 18 are formed at the exterior circumference of the middle portion of the body 14 so as to communicate with the chamber, and the other ends of the first and second hydraulic lines 16 and 18 are joined in the body 14. Therefore, the oil of the chamber flows through the first and second hydraulic lines 16 and 18.

The joining line 20 is formed in the body 14 and extends toward the supply line 5. More concretely, one end of the joining line 20 is connected to the other ends of the first and second hydraulic lines 16 and 18, and the other end of the joining line 20 extends to the other end of the body 14 so as to be connected to the supply line 5. Therefore, the oils passing through the first and second hydraulic lines 16 and 18 are joined at the joining line 20 and are supplied to the supply line 5 through the joining line 20.

In addition, when the oils passing through the first and second hydraulic lines 16 and 18 are joined at the joining line 20, pulsations of the oils are reduced. For this purpose, lengths of the first and second hydraulic lines 16 and 18 are different from each other.

In another exemplary embodiment of the present invention, the end of the joining line is wider than the other end thereof to form a conical shape. In this configuration, the oil pulsation will be further reduced while the oil passes through the joining line 20.

Reduction of oil pulsation will be described referring to FIG. 5.

Figure 5:
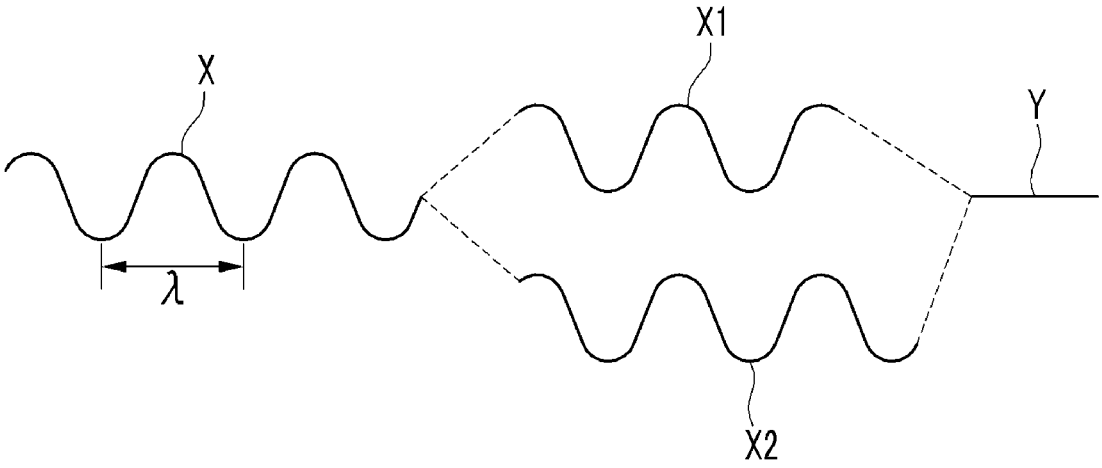
FIG. 5 is a schematic diagram showing pulsations of oils passing through each hydraulic line formed at a hydraulic orifice according to an exemplary embodiment of the present invention.

FIG. 5 is a schematic diagram showing pulsations of oils passing through each hydraulic line formed at a hydraulic orifice according to an exemplary embodiment of the present invention.

In FIG. 5, an oil flow in the chamber is denoted by X, and an oil flow in the joining line 20 is denoted by Y. In addition, an oil flow in the first hydraulic line 16 is called a first oil flow X1, and an oil flow in the second hydraulic line 18 is called a second oil flow X2.

If the oil flow X having a pulsation with a constant cycle is flowed in the chamber, the oil is input respectively to the first and second hydraulic lines 16 and 18. At this time, cycle of the pulsation of the first oil flow X1 is the same as that of the pulsation of the second oil flow X2.

If the length of the first hydraulic line 16 is the same as that of the second hydraulic line 18, the first oil flow X1 joins the second oil flow X2 with the same phase, and the pulsation of the oil flow Y in the joining line 20 is not reduced from the pulsation of the oil flow X in the chamber.

If the length of the first hydraulic line 16 is different from that of the second hydraulic line 18, the first oil flow X1 and the second oil flow X2 are joined with different phases, and the pulsation of the oil flow Y in the joining line 20 may be reduced from that of the oil flow X in the chamber. As shown in FIG. 5, if the first oil flow X1 and the second oil flow X2 are joined with a phase difference of 180°, the pulsation of the oil flow Y in the joining line 20 vanishes.

For this purpose, if wavelength of the pulsation is $\lambda$, a difference between the lengths of the first and second hydraulic lines 16 and 18 may be $(2n+1)*\lambda$. Herein, n is integer.

Meanwhile, if the length the first hydraulic line 16 is different from that of the second hydraulic line 18, the pulsation of the oil in the joining line 20 may be reduced. If the lengths of the first and second hydraulic lines 16 and 18 are different from each other, the first oil flow X1 and the second oil flow X2 reaching the joining line 20 have different phases with each other. Therefore, the pulsation of the oil flow Y in the joining line 20 may be removed (even if the first oil flow and the second oil flow are joined with the same phase, the pulsation of the oil flow Y in the joining line 20 is the same as that of the oil flow X in the chamber, not be increased.).

So as to reduce the pulsation of the oil, means for changing phase of the oil may be mounted at one of the first and second hydraulic lines 16 and 18 instead of controlling the lengths of the first and second hydraulic lines 16 and 18. For example, a penetration membrane with different refractive index may be mounted at one of the first and second hydraulic lines 16 and 18 so as to change the phase of the oil when the oil passes through the penetration membrane.

Figure 6:
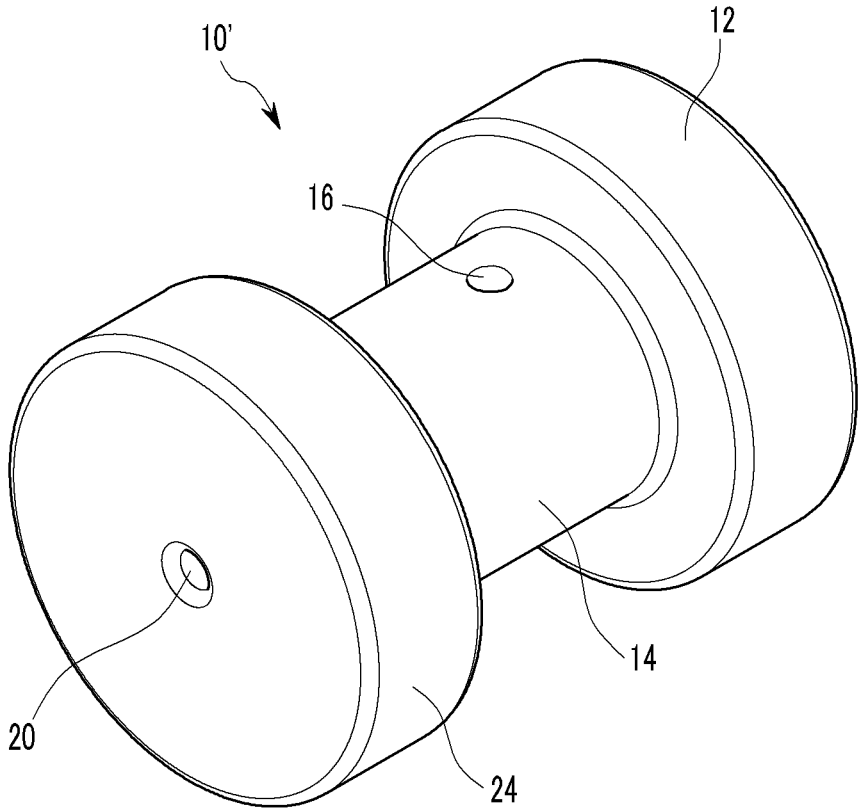
FIG. 6 is a perspective view of a hydraulic orifice according to another exemplary embodiment of the present invention.

FIG. 6 is a perspective view of a hydraulic orifice according to another exemplary embodiment of the present invention. For better comprehension and ease of description, the same constituent elements will be denoted by the same reference numerals.

A hydraulic orifice 10' according to the second exemplary embodiment of the present invention is the same as that 10 according to the first exemplary embodiment of the present invention except shape of the other end of the hydraulic orifice 10. According to the second exemplary embodiment of the present invention, one end 12 of the body 14 has the same diameter as the other end 24 of the body 14. Therefore, the other end 24 of the body 14 is pressed not on the supply line 5 but on the head oil journal 3, and the chamber is formed between the both ends 12 and 24 of the body and the head oil journal 3.

Operation of the second exemplary embodiment of the present invention is the same as that of the first exemplary embodiment of the present invention, and detailed description thereof will be omitted.

Meanwhile, it is exemplified in the exemplary embodiments of the present invention that two hydraulic lines 16 and 18 are used for supplying the oil in the chamber to the joining line 20, but the number of the hydraulic lines is not limited to this. That is, at least two hydraulic lines may be used for supplying the oil in the chamber to the joining line 20. In addition, at least two hydraulic lines have different lengths to each other.

As described above, since a joining line and at least two hydraulic lines connecting the joining line with a head oil journal are formed at a body of one piece and oils passing through at least two hydraulic lines are joined at the joining line with different phases, pulsation of the oil may be reduced according to the present invention.

In addition, since the head oil journal is used as a chamber, a structure may be simple. In addition, the hydraulic orifice can be easily assembled and manufacturing cost may be reduced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A hydraulic orifice which is mounted at a head oil journal formed in a cylinder head and supplies an oil to a supply line after reducing pulsation of the oil supplied to the head oil journal, the hydraulic orifice comprising:

a body pressed on the head oil journal so as to form a chamber with the cylinder head;

a joining line formed along a longitudinal axis of the body therein and fluid-communicating with the supply line; and at least two hydraulic lines formed in the body and connecting the chamber with an end of the joining line in the body to supply the oil through the other end thereof to the supply line, wherein the oils passing through the at least two hydraulic lines are joined at the end of the joining line with different phases such that the pulsation of the oil in the joining line is reduced.

2. The hydraulic orifice of claim 1, wherein the at least two hydraulic lines have different lengths such that the oils passing through the at least two hydraulic lines are joined at the end of the joining line with the different phases.

3. The hydraulic orifice of claim 1, wherein the end of the joining line is wider than the other end thereof to form a conical shape.

4. The hydraulic orifice of claim 1, wherein the head oil journal abuts on the supply line, and a diameter of the head oil journal is larger than that of the supply line, and wherein an end of the body is pressed on the head oil journal and the other end of the body is pressed on the supply line such that the chamber is formed between the end of the body and the head oil journal.

5. The hydraulic orifice of claim 1, wherein the head oil journal abuts on the supply line, and a diameter of the head oil journal is larger than that of the supply line, and wherein a diameter of both ends of the body is larger than that of a middle portion of the body and the both ends of the body are pressed on the head oil journal such that the chamber is formed between the both ends of the body and the head oil journal.

6. A hydraulic orifice which is mounted at a head oil journal formed in a cylinder head and supplies an oil to a supply line after reducing pulsation of the oil supplied to the head oil journal, the hydraulic orifice comprising:

a body;

first and second hydraulic lines formed in the body and receiving the oil from the head oil journal; and a joining line formed along a longitudinal axis in the body, joining the first and second hydraulic lines at an end thereof, and supplying the oil supplied through the first and second hydraulic lines to the supply line through the other end thereof, wherein a first oil flow passing through the first hydraulic line and a second oil flow passing through the second hydraulic line are joined at the end of the joining line with different phases.

7. The hydraulic orifice of claim 6, wherein a length of the first hydraulic line is different from that of the second hydraulic line such that the first oil flow and the second oil flow are joined at the end of the joining line with different phases.

8. The hydraulic orifice of claim 7, wherein a phase difference between the first oil flow and the second oil flow is approximately 180°.

9. The hydraulic orifice of claim 6, wherein the head oil journal abuts on the supply line, and a diameter of the head oil journal is larger than that of the supply line, and wherein an end of the body is pressed on the head oil journal and the other end of the body is pressed on the supply line such that a chamber is formed between the end of the body and the head oil journal.

10. The hydraulic orifice of claim 6, wherein the head oil journal abuts on the supply line, and a diameter of the head oil journal is larger than that of the supply line, and wherein a diameter of both ends of the body is larger than that of a middle portion of the body and the both ends of the body are pressed on the head oil journal such that a chamber is formed between the both ends of the body and the head oil journal.

11. The hydraulic orifice of claim 6, wherein the end of the joining line is wider than the other end thereof to form a conical shape.

* * * * *